United States Patent [19]

Moye

[11] Patent Number: 5,033,737

[45] Date of Patent: Jul. 23, 1991

[54] ADJUSTABLE HURDLE

[75] Inventor: Charles W. Moye, Akron, Ohio

[73] Assignee: All Ohio Youth Athletic Club, Akron, Ohio

[21] Appl. No.: 475,922

[22] Filed: Feb. 6, 1990

[51] Int. Cl.[5] ..... A63B 5/02

[52] U.S. Cl. ..... 272/103; 272/62; 272/DIG. 4; 182/182; 211/203; 248/164

[58] Field of Search ..... 272/62, 63, 101, 102, 272/103, 144, DIG. 4; 182/182; 211/203; 248/164

[56] References Cited

U.S. PATENT DOCUMENTS

| | | | |
|---|---|---|---|
| 468,625 | 2/1892 | Medart | 272/103 |
| 615,443 | 12/1898 | Foster | 202/103 |
| 1,044,128 | 11/1912 | Brook | 272/103 |
| 1,295,265 | 2/1919 | Bradley | 211/203 X |
| 1,737,108 | 11/1929 | Craig | 272/103 |
| 2,368,740 | 2/1945 | Blomgren | 248/164 X |
| 2,410,330 | 10/1946 | Ashenfelter | 182/182 |
| 2,572,928 | 10/1951 | Hawes | 272/103 X |
| 3,024,022 | 3/1962 | Goyette | 272/103 |
| 3,394,932 | 7/1968 | Leflar | 272/103 |
| 3,685,824 | 8/1972 | Quinn | 272/103 |

FOREIGN PATENT DOCUMENTS

| | | | |
|---|---|---|---|
| 654576 | 12/1962 | Canada | 272/103 |
| 1116538 | 5/1956 | France | 272/103 |
| 243633 | 12/1925 | United Kingdom | 272/103 |
| 819145 | 8/1956 | United Kingdom | 272/103 |

*Primary Examiner*—Robert Bahr

*Attorney, Agent, or Firm*—Renner, Kenner, Greive, Bobak, Taylor & Weber

[57] ABSTRACT

Adjustable hurdle apparatus (10, 110) positionable on a running track as a barrier to runners in track events including a supporting framework (11, 111), a horizontal crossbar (45, 75, 120) to be cleared by runners positioned proximate an extremity of the supporting framework, a base (12, 112) attached to the supporting framework proximate the extremity of said framework opposite the horizontal crossbar for normally maintaining the supporting framework in a substantially vertical orientation relative to the track, and means (25, 26; 75, 76; 130) for infinitely adjustably vertically positioning the horizontal crossbar from competition heights to heights which are substantially below the lowest competition height.

8 Claims, 3 Drawing Sheets

ADJUSTABLE HURDLE

TECHNICAL FIELD

Generally, the present invention relates to hurdles employed in the sport of track and field. More particularly, the present invention relates to hurdles for use in training athletes for competition in track and field hurdle events. More specifically, the invention relates to a training hurdle which is height adjustable to facilitate the conduct of training drills to enhance the performance of athletes who compete in the sport of track and field in hurdle events.

BACKGROUND ART

Track and field competition has long included running events involving hurdles which are vertical barriers that are to be negotiated by the runners. Normally, there are a plurality of spaced hurdles that must be negotiated during the course of a race. Those events which involve shorter distances in the sprint range are commonly referred to as hurdle events. Longer distance races, which in addition to hurdles may have water jumps, are commonly termed steeplechase events.

In both hurdle events and steeplechase events, the specified height of the hurdles may vary in different events. For example, the height of the crossbar may range from about 30 inches to about 42 inches. Events where the height of the hurdles is in the lower portion of this range are often termed low hurdle events, and where the height is in the upper portion of this range are often termed high hurdle events. In addition, somewhat different heights of the hurdles are specified for men's and women's events and for youth competition. For virtually all events, hurdle heights are one of five heights represented by three (3) inch increments from 30 inches to 42 inches, i.e., 30 inches, 33 inches, 36 inches, 39 inches or 42 inches.

Some years ago, there were only two basic hurdle heights, one for low hurdle events and one for high hurdle events. At that time, most hurdles had a pivoting member with a crossbar which when pivoted upwardly relative to the frame was the correct height for high hurdle events and when pivoted downwardly had a second crossbar at the correct height for low hurdle events. More recently, with the advent of additional hurdle heights for different events, efforts have been made to design hurdles which can be adjusted to the full range of heights discussed above. This normally results in the use of telescoping members with the internal member having a projecting spring loaded plunger and the external member having a plurality of longitudinally spaced apertures for receiving the plunger and placing the crossbar at any selected one of the various operating heights.

Besides the increasing number of height positions, the primary additional requirement of competition hurdles is that the weight and balance of the hurdle be such that the resisting or pullover force be of specified magnitudes on the order of 6 to 8 pounds. This represents a continuous horizontal pulling force applied to the center of the crossbar in the direction of a runner's progress. In order to achieve the necessary pullover force for different hurdle heights, it is normally necessary that one or more movable counterweights be variably positioned along the feet or legs of the hurdle to effect this adjustment. This necessity for more height adjustments and for movable counterweights has made competition hurdles more complex, more expensive and more subject to damage or operational defects.

The increased cost and susceptibility to damage has, in some cases, limited access to competition hurdles for training and practice purposes. As a result, in at least some instances, coaches and athletes have resorted to makeshift devices, such as poles horizontally positioned on end supports, to simulate hurdles. In addition, modern training theories have given rise to demands for different training equipment. While training techniques formerly contemplated that essentially all practice activity take place using hurdles set only at competition heights, more recently there is substantial interest in conducting practice drills and training exercises for hurdle events and other track and field events with a hurdle crossbar at a variety of different heights which are frequently nonstandard heights and heights which are substantially below the lowest competitive height of 30 inches. Since competition hurdles cannot be employed for these purposes, there is a necessity for resorting to makeshift devices to provide the necessary equipment. To the present time, there is no commercially available equipment which meets the operational and cost parameters necessary for an adjustable hurdle which can be employed particularly for training purposes.

DISCLOSURE OF THE INVENTION

Therefore, an object of the present invention is to provide a hurdle for track and field which is height adjustable from standard competition heights to reduced heights substantially below the lowest competition height. Another object of the present invention is to provide such a hurdle which is infinitely height adjustable from standard competition heights down to heights as low as several inches. A further object of the present invention is to provide such a hurdle which can be quickly and easily adjusted over its height range by a single individual and can be collapsed to form a compact, lightweight package, such that a single individual can readily transport a number of hurdles to facilitate a rapid, relatively easy erection or removal of a hurdle course.

Another object of the present invention is to provide a hurdle for track and field which is particularly adapted for use as a practice or training device. Still another object of the present invention is to provide such a hurdle which is sufficiently compact and lightweight that one person can readily simultaneously transport and handle several hurdles. A further object of the invention is to provide such a hurdle which although of lightweight construction, may be weighted to have resisting or pullover forces of a significant magnitude such that reasonably realistic actions and reactions are experienced when the crossbar is directed engaged or struck a glancing blow by the foot of a runner. Another object of the present invention is to provide such a hurdle in which the components are of a structural material and configuration which minimizes risk of injury to athletes. Still a further object of the present invention is to provide such a hurdle which is substantially less expensive than and can be repaired at less cost than standard competition hurdles.

An object of a first embodiment of the present invention is to provide a hurdle for track and field in which the framework and the base are mounted at right angles to each other and both mount a cross bar, whereby the orientation of the hurdle can be reversed to provide differing crossbar heights. A further object of this embodiment of the present invention is to provide such a hurdle wherein both crossbars are adjustably extensibly mounted so that together they cover the desired range of operating heights Still another object of this embodiment of the present invention is to provide such a hurdle in which the crossbar and overall appearance bear a strong resemblance to a conventional competition hurdle.

An object of a second embodiment of the present invention is to provide a hurdle for track and field in which the framework includes cross struts which join and selectively space the crossbar and the base. A further object to this embodiment of the present invention is to provide such a hurdle in which the cross struts of the framework are selectively joined at a movable pivot point which may be a floating pivot or one of a plurality of pivot locations. Yet another object of this embodiment of the present invention is to provide such a hurdle wherein various base members may be employed having different weights, differing weight distribution or differing lever arm lengths for purposes of adjusting the resisting or pullover force for differing height settings. Still a further object of this embodiment of the invention is to provide a cover for the crossbar which may serve as a carrying case encompassing the entire hurdle in its collapsed configuration. Yet a further object of this embodiment of the invention is to provide a floating pivot having a tension adjustable clinching device joining the cross struts of the framework.

In general, adjustable hurdle apparatus positionable on a running track as a barrier to runners in track events according to the invention includes supporting framework, a horizontal crossbar to be cleared by runners positioned proximate an extremity of the supporting framework, a base attached to the supporting framework proximate the extremity of the framework opposite the horizontal crossbar for normally maintaining the supporting framework in a substantially vertical orientation relative to the track, and means for infinitely adjustably vertically positioning the horizontal crossbar from competition heights to heights which are substantially below the lowest competition height.

PREFERRED EMBODIMENT FOR CARRYING OUT THE INVENTION

Figure 1:
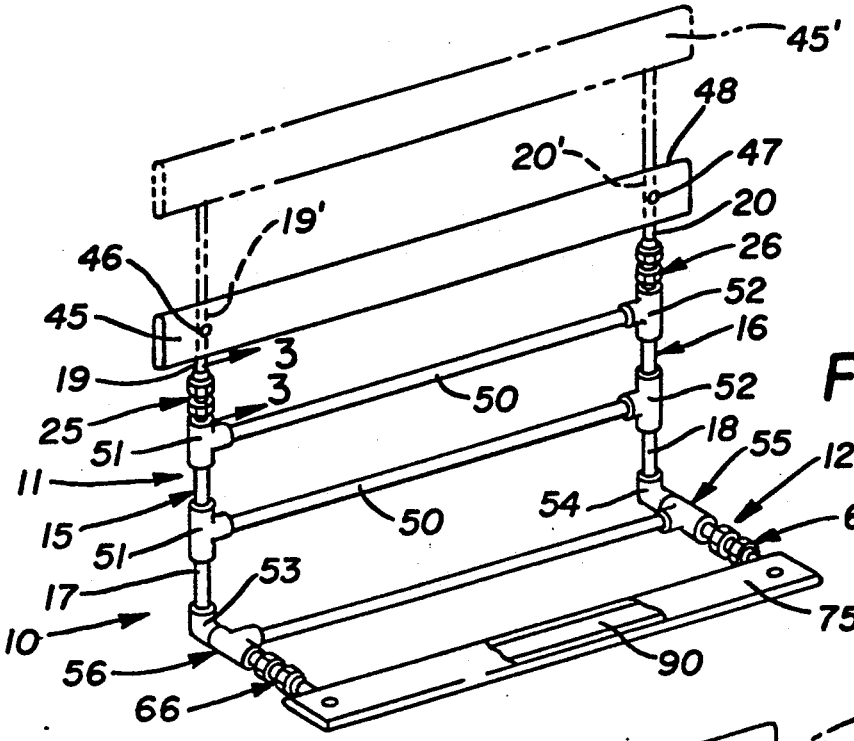
FIG. 1 is a perspective view of an exemplary training hurdle embodying the concepts of the present invention oriented for the higher cross bar positioning range, with an exemplary elevated crossbar position depicted in chain lines and with a portion of a crossbar broken away to show a weighting element.
Figure 2:
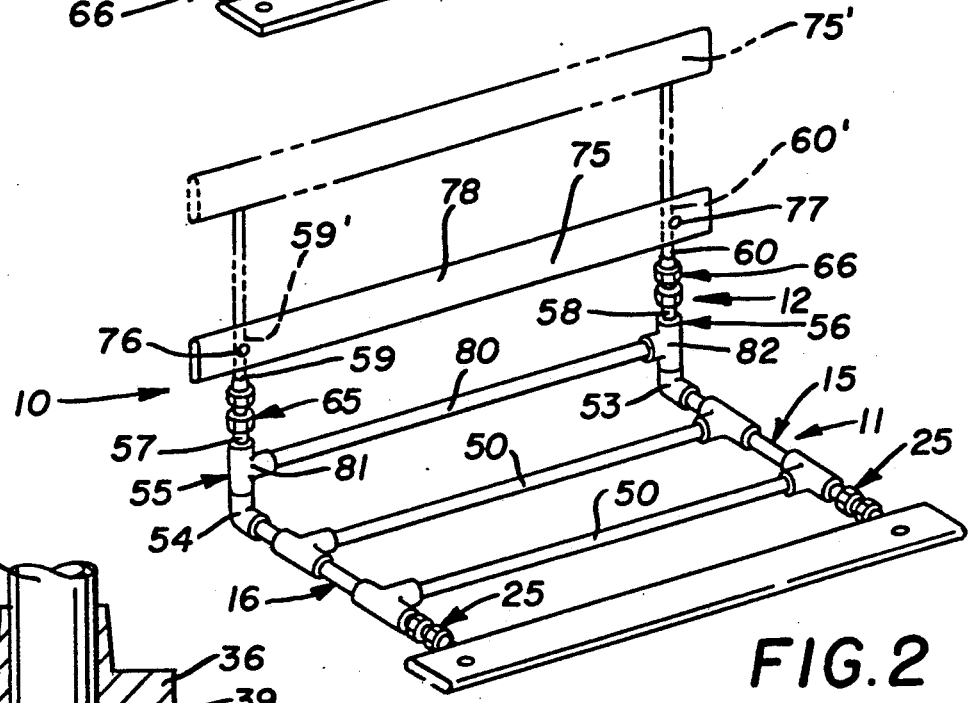
FIG. 2 is a perspective view of the training hurdle of FIG. 1 oriented for the lower crossbar positioning range, with an exemplary elevated crossbar position depicted in chain lines.
Figure 3:
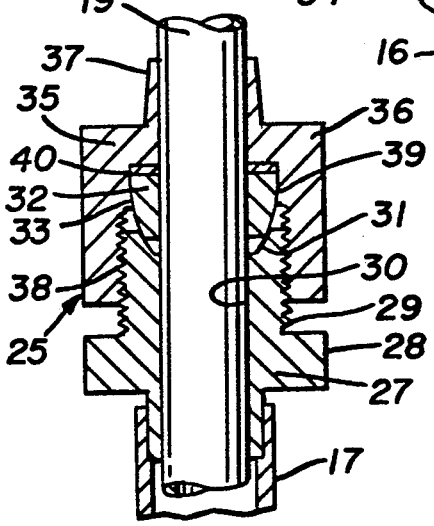
FIG. 3 is a cross-sectional view taken substantially along the line 3—3 of FIG. 1 showing details of the locking assembly for the telescoping arms.

An adjustable training hurdle for use as a barrier in track events having hurdles according to the concepts of the present invention and particularly the first embodiment of FIGS. 1-3 of the drawings, is generally indicated by the numeral 10. The adjustable training hurdle 10 has an upstanding framework, generally indicated by the numeral 11, and an attached base, generally indicated by the numeral 12. The framework 11 and the base 12 are each of a generally planar overall configuration and preferably disposed at substantially right angles to each other, whereby when either is positioned on a running track, the other is substantially vertically oriented. In this respect, it is to be noted that in the operating position depicted in FIG. 1, the base 12 is oriented horizontally, as if positioned on a running track, with the framework 11 vertically oriented; in the other operating position depicted in FIG. 2, the framework 11 is oriented horizontally, as if positioned on a running track, with the framework 11 vertically oriented. In this manner, the full height adjustment range of the hurdle 10 is achieved as detailed hereinafter.

The framework 11 includes a pair of arm assemblies, generally indicated by the numerals 15 and 16, which are preferably substantially parallel. The arm assemblies 15, 16 have fixed pipes 17 and 18, respectively, as the portion nearest the base 12. The leg assemblies 15, 16 also have movable pipes 19 and 20, respectively, which interfit with the fixed pipes 17 and 18, respectively, as best seen in FIG. 3. The extent of telescopic engagement between the movable pipes 19, 20 and their respective fixed pipes 17, 18 is effected by compression fittings, generally indicated by the numerals 25 and 26, which may be identical.

As best seen in FIG. 3, the compression fitting 25 is mounted at the extremity of the fixed pipe 17 into which the movable pipe 19 telescopes. In conventional fashion, the compression fitting 25 has a fixed connector 27 which is attached at the extremity of fixed pipe 17. The fixed connector has a radially projecting gripping portion 28 with an axially exterior threaded area 29 extending therefrom. The fixed connector 27 has a central axial bore 30 which is sized to snugly accommodate the outer surface of the movable pipe 19. The end of the fixed connector 27 having the exterior threaded area 29 has a conical surface 31 which terminates in the bore 30. The conical surface 31 is adapted to receive a compression sleeve 32 having an arcuate surface 33 which contacts the conical surface 31 of fixed connector 27.

The compression sleeve 32 is positioned relative to the fixed connector 27 by a compression nut 35. The compression nut 35 has an exterior gripping surface 36 and at one axial extremity thereof a tapered housing 37 which receives and effects alignment with the movable pipe 19. The compression nut 35 has an internal threaded portion 38 which matingly engages the threaded area 29 on the fixed connector 27. The compression nut 35 also has a reduced diameter inner bore 39 which is adapted to receive and contain the compression sleeve 32. Interposed between the axial inner extremity of bore 39 and the axial extremity of compression sleeve 32 is a spring washer 40. It will thus be appreciated by persons skilled in the art that tightening of the compression nut 35 relative to the fixed connector 27 by relative rotation will effect radially inward distortion of the compression sleeve 32 to thereby lock the movable pipe 19 relative to the compression fitting 25, thus permitting positioning of the movable pipe 19 at a desired location relative to the fixed pipe 17. It will also be appreciated that a manual operation of the compression nut 35 through a few turns will relieve the pressure produced by compression sleeve 32 on movable pipe 19 such that it can be readily axially adjusted relative to compression fitting 25 and fixed pipe 17. Thus, the combined length of the fixed pipe 17 and movable pipe 19 may be readily manually adjusted as desired.

Referring again to FIG. 1 of the drawings, the movable pipes 19, 20 mount at their axial extremities a horizontal crossbar 45. As shown, the crossbar 45 is preferably a hollow rectangular element which is preferably constructed of a high-impact polycarbon or other comparable material to withstand repeated impact by the feet of runners. The crossbar 45 is preferably constructed to receive axial extremities 19' and 20' of the movable pipes 19 and 20 at a position proximate to but spaced inwardly of the extremities of crossbar 45 and is affixed by suitable fasteners 46 and 47. For both strength and safety considerations, the crossbar 45 may have rounded corners 48, at least at the upward extremity as seen in FIG. 1 where the hurdle is most likely to be accidentally engaged by a foot, leg, or other body part of a runner.

The framework 11 has joining the arm assemblies 15 and 16 and preferably on the fixed pipes 17 and 18, one or more cross braces 50. As shown, the cross braces 50, 50 terminate at the lateral extremities thereof in tee connectors 51 and 52, which are preferably rigidly attached on the fixed pipes 17 and 18, respectively. With one or more cross braces 50 paralleling the crossbar 45, it will be appreciated that the framework 11 exhibits substantial structural rigidity. All of the elements of the framework 11, except as noted in regard to crossbar 45, may be satisfactorily constructed of a plastic such as ¾" polyvinylchloride piping to provide substantial strength, yet a relatively lightweight product.

In the position of the hurdle 10 depicted in FIG. 1, it will be appreciated that the crossbar 45 may be adjusted over a height range from that depicted in solid lines through the position depicted in chain lines as 45' to a position which is nearly twice the height of the solid line position of crossbar 45, if the movable pipes 19, 20 are of sufficient length to telescope the full distance interiorly of the compression fittings 25, 26 and the fixed pipes 17, 18. This adjustment of the height of the crossbar 45 of framework 11 provides infinite vertical adjustment of the crossbar over the upper ranges of the height adjustment which the hurdle 10 provides. The height adjustment of crossbar 45 is effected merely by loosening the compression fittings 25, 26, as described hereinabove, moving the crossbar 45 with attached movable pipes 19, 20 to a desired position, and retightening the compression fittings 25, 26.

Further referring to FIGS. 1 and 2 of the drawings, it is to be noted that the configuration and components of the base 12 may be similar or identical to corresponding components of the framework 11. The base 12 includes a pair of arm assemblies, generally indicated by the numerals 55 and 56, which are preferably substantially parallel. The arm assemblies 55, 56 have fixed pipes 57 and 58, respectively, as the portion nearest the framework 11. The arm assemblies 55, 56 also have movable pipes 59 and 60, respectively, which interfit with the fixed pipes 57 and 58, respectively, in the same manner said pipes 17 and 19 interfit as previously described in conjunction with FIG. 3. The extent of telescopic engagement between the movable pipes 59, 60 and their respective fixed pipes 57, 58 is effected by compression fittings, generally indicated by the numerals 65 and 66, which may be identical to the compression fittings 25, 26.

The fixed pipes 57, 58 mount at their axial extremities a horizontal crossbar 75. As shown, crossbar 75 is preferably a hollow rectangular element which is preferably constructed of a high-impact polycarbon or other comparable material to withstand repeated impact by the feet of runners. The crossbar 75 is preferably to constructed to receive axially extremities 59' and 60' of movable pipes 59 and 60 at a position proximate to but spaced inwardly of the extremities of crossbar 75 and is affixed by suitable fasteners 76 and 77. For the reasons specified above in conjunction with the crossbar 45, the crossbar 75 may have rounded corners 78, at least at the upward extremity as seen in FIG. 2 where the hurdle is most likely to be accidentally engaged by a foot, leg, or other body part of a runner.

The base 12 has joining the arm assemblies 55, 56, and preferably on the fixed pipes 57, 58, one or more cross braces 80. As shown, a single cross brace 50 is provided which terminates at the lateral extremities thereof in tee connectors 81 and 82, which are preferably rigidly attached on the fixed pipes 57, 58, respectively. Due to the reduced extent of the base 12, a single cross brace 80 may afford sufficient structural rigidity for the base 12. The elements of the base 12 may be of the same general configuration and material as indicated hereinabove in conjunction with the framework 11.

As seen in FIG. 1, the crossbar 75, as a hollow member, may be provided with a weighting bar 90 which may conveniently be positioned internally of crossbar 75. While different arrangements of a weighting bar 90 might be employed, a metallic bar extending internally of crossbar 75 the entire distance between the movable pipes 59, 60, is advantageous in providing uniformly distributed weighting with reference to the width of the hurdle 10. The weighting bar 90 provides increased overall weight for hurdle 10 at a desired resistance to pullover forces registered when the hurdle 10 is engaged by a runner.

The framework 11 and base 12 are joined in substantially perpendicular relation by couplings 53 and 54. As shown, the couplings 53 and 54 may be conventional 90 degree pipe elbows which join fixed pipe 17 with fixed pipe 58 and fixed pipe 18 with fixed pipe 57, respectively.

In the position of the hurdle 10 depicted in FIG. 2 of the drawings, it will be appreciated that the crossbar 75 may be adjusted over a height range from that depicted in solid lines, which is the lowest practice height for hurdle 10, through the position depicted in chain lines as 75' to a position which is nearly twice the height of the solid line position of crossbar 75 if the movable pipes 59, 60 are a sufficient length to telescope the full distance interiorly of the compression fittings 65, 66 and the fixed pipes 57, 58. The highest position of the crossbar 75 is preferably on the order of or slightly less than the lowest height of adjustment of the crossbar 45 when the hurdle is in the position depicted in FIG. 1 for purposes of effecting coverage of the entire desired height range. The operational adjustment of the crossbar 75 is identical to that detailed hereinabove in conjunction with the description of the crossbar 45 of the framework 11.

Figure 4:
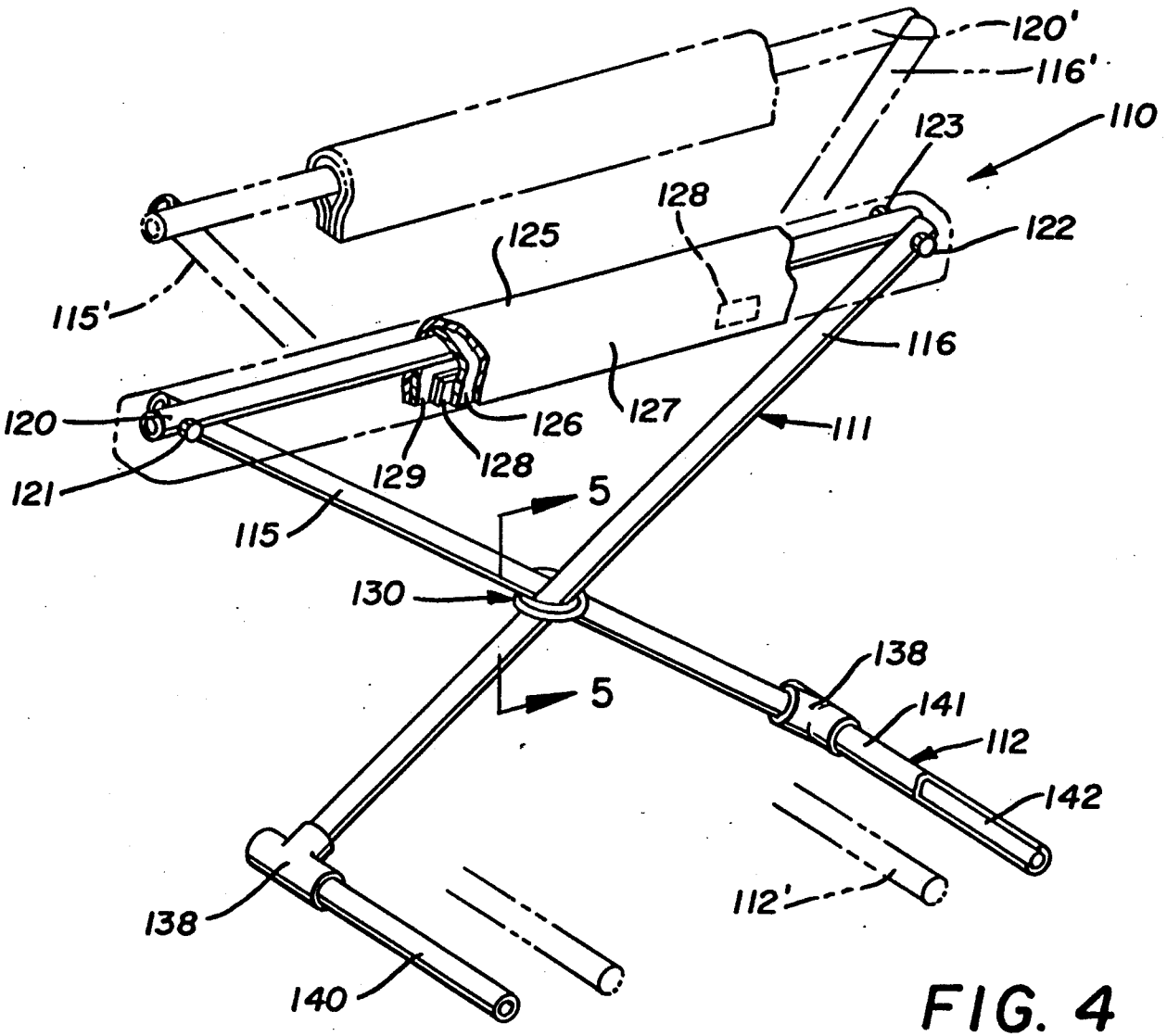
FIG. 4 is a perspective view of an exemplary training hurdle showing a second embodiment of the concepts of the present invention, with an exemplary elevated crossbar position depicted in chain lines.
Figure 5:
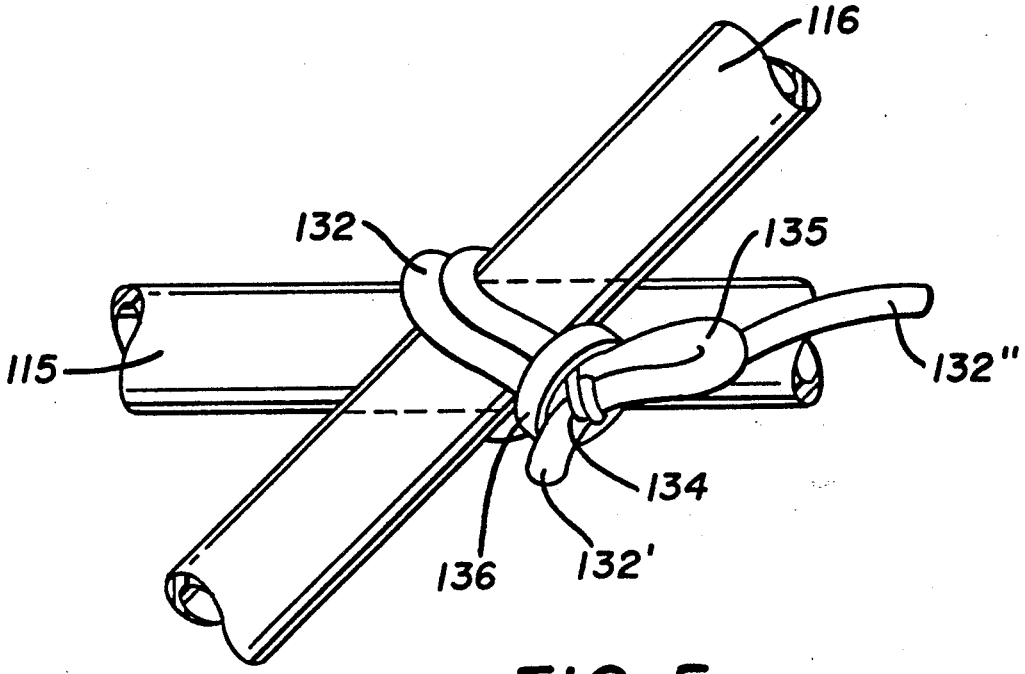
FIG. 5 is an enlarged fragmentary elevational view as seen substantially along line 5—5 of FIG. 4 showing details of the floating pivot of the second embodiment of the invention.
Figure 6:
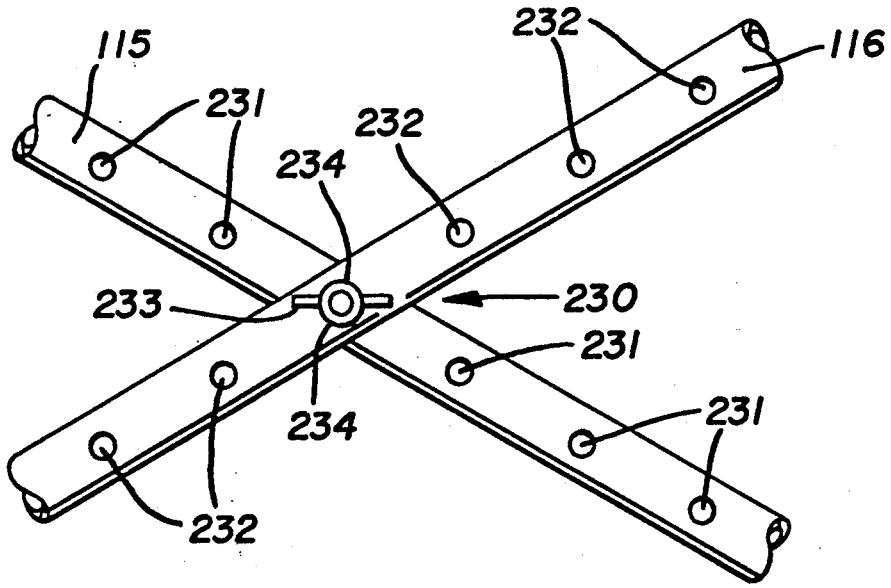
FIG. 6 is an enlarged fragmentary front elevational view of the training hurdle of FIG. 4 showing a multiple location pivot constituting an alternate form of the pivot of FIG. 5.

An adjustable training hurdle for use as a barrier in track events having hurdles according to the concepts of the present invention and particularly the second embodiment of FIGS. 4–6 of the drawings, is generally indicated by the numeral 110. The adjustable training hurdle 110 has an upstanding framework, generally indicated by the numeral 111, and an attached base, generally indicated by the numeral 112. The framework 111 and the base 112 are each of a generally planar overall configuration and preferably disposed at substantially right angles to each other. In this embodiment of the invention, it is to be noted that there is but the single operating position depicted in FIG. 4 wherein the base 112 is positioned horizontally as if positioned on a running track with the framework 111 being vertically oriented. The full height adjustment of the hurdle 110 is realized in this single orientation in a manner detailed hereinafter.

The framework 111 includes a pair of cross struts 115 and 116 which form a generally X-shaped configuration. The cross struts 115, 116 mount proximate their upper axial extremities a crossbar 120. The crossbar 120 is freely rotatably mounted on the cross struts 115, 116 as by machine screws 121 and 122 and engaging nuts 123 which may advantageously be of a suitable plastic to permit an extent of deflection and serve to reduce the possibility of injury to athletes. As shown, the crossbar 120 is a tubular member which is enclosed within a hood-like cover 125 which may extend the full length of crossbar 120 and encompass the upper extremities of the cross struts 115, 116 for purposes precluding the possibility of scratches or other abrasions to a runner which might be caused by the upper extremity of the struts 115, 116 or the machine screws 121, 122 and nuts 123. As shown, the cover 125 may have an internal foam lining 126 with an attached surface material 127 of greater abrasion and tear resistance, such as a vinyl fabric. In this manner, both the hurdle 110 and runners are protected from possible damage or injury despite repeated engagement of hurdle 110 by the foot, leg, or other body parts of a runner. The cover 125 may have longitudinally continuous, or as shown, discontinuous velcro strips 128 proximate the edges 129 to selectively secure cover 125 about the crossbar 120 and upper extremities of cross struts 115, 116. If desired, the cover 125 may be sufficiently oversized to encompass the struts 115 and 116 in an collapsed, parallel position, as well as the elements of base 112, when removed, and thus serve as a carrying case for the hurdle 110. It is to be appreciated that a crossbar comparable to the crossbars 45 and 75 employed in conjunction with the hurdle 10 of the first embodiment of the invention could be adapted for use as crossbar 120, as well as other configurations providing a padded, but impact resistant, construction.

The framework 111 has a moving pivot assembly, generally indicated by the numeral 130, interconnecting the cross struts 115, 116. The moving pivot assembly 130, as seen in FIGS. 4 and 5, is in the nature of a floating pivot employing a clinching device 131 which encircles the cross struts 115, 116. As seen, the clinching device 131 includes an elastomeric band 132 preferably looped twice about the struts 115, 116 for purposes of providing improved gripping support. It will be appreciated that the elastomeric band 132, which is preferably of circular cross section, moves longitudinally of each of the struts 115, 116 as the struts are adjusted to different angles to effect changes in the height of the crossbar 120. Since the cross struts and other components of hurdle 10 may be readily constructed of polyvinylchloride piping, it has been found advantageous to employ an elastomeric band 132, having a fabric cover 133 so that the band 132 will more readily slide to the appropriate position longitudinally of cross struts 115, 116 as adjustments in the height of crossbar 120 are made.

While the clinching device 131 may merely secure the elastomeric band 132 with a fixed length looped about the struts 115, 116, it is advantageous to employ the adjustable tension configuration depicted in FIGS. 4 and 5 of the drawings. As shown, the clinching device 131 includes a clamping ring 134 which is employed to form a loop 135 in elastomeric band 132 which is preferably proximate to and forms a projecting release extremity 132' of elastomeric band 132. The elastomeric band 132 extends through a grommet 136, around the struts 115, 116, and has a pull extremity 132" extending back through the grommet 136. The grommet 136 is preferably an annular member which does not have the internal edges rounded to facilitate gripping the elastomeric band 132. To achieve optimum operation, the inner diameter of the grommet 136 is approximately twice the diameter of the elastomeric band 132.

When assembled as shown in FIGS. 4 and 5, the elastomeric band 132 operates by exerting force on pull extremity 132" in a direction away from grommet 136 to tension band 132. This tends to pull loop 135 through grommet 136 such that the elastomeric band 132 is forced into engagement with and locked against the internal diameter of grommet 136. It will be appreciated that elastomeric band 132 can be tightened to any desired extent by merely exerting additional force on pull extremity 132". Loosening or release of band 132 from a tightened position is effected by merely applying a force to release extremity 132' or loop 135 directed away from the grommet 136, whereby loop 135 is separated from grommet 136 releasing the locking pressure on elastomeric band 132, such that the pull extremity 132" feeds back through grommet 136 as a result of tension in elastomeric band 132. The fabric cover 133 on elastomeric band 132 is of a material selected to give appropriate friction resistance to permit ease of locking and release of the elastomeric band 132. It will be appreciated that clinching device 131 may be adjusted to maintain desired tension after it has been used for some time and band 132 loses some elasticity or the tension therein otherwise becomes reduced. It is also to be noted that one or more clinching devices 131 may be employed to secure hurdle 110 in the collapsed position in addition to or in lieu of the cover 125 or in other applications where a non-complex adjustable clinching device is required to encircle and apply pressure to or restrain a member or members.

In instances where a limited number of discrete heights of the crossbar 120 are satisfactory for usage purposes of the hurdle 110, an alternate form of movable pivot, generally indicated by the numeral 230, may be employed as depicted in FIG. 6 of the drawings. In this instance, the struts 115 and 116 may be provided with a plurality of bores 231 and 232, respectively, which are spaced at discrete intervals longitudinally of the struts 115, 116. The struts are connected at the appropriate juncture point for a particular height of crossbar 120 as by a threaded fastener 233. The fastener 233 is maintained in the appropriate bores 231 and 232 as by a wing nut 234 or other threaded element capable of easy manual actuation. It will be appreciated that height adjustments of crossbar 120 employing the moving pivot 230 are made by removal of the wing nut 234 from the threaded fastener 233, removing the threaded fastener from bores 231, 232 and adjusting the struts 115, 116 for a desired hurdle height and then reinserting the fastener 233 in appropriate bores 231, 232 and reapplying the wing nut 234 to the fastener 233 at the new location. Alternatively, if a similar type of floating pivot is desired, the struts 115, 116 may be provided with elongate slots extending longitudinally thereof in lieu of the bores 231, 232. The fastener 233 or other comparable securing device, would slide in such slots to infinitely adjustably position the crossbar 120 at any desired vertical height within the range of operating heights of hurdle 110.

The framework 111 and the base 112 are interrelated by connectors 138. As shown in FIG. 4, the connectors 138 are conventional tee connectors for piping, which position the struts 115 and 116 of framework 111 and the base 112 at substantially right angles such that as when base 112 is positioned on a track, the framework 111 is in a substantially vertical plane. The tee connectors 138, 138 may provide additional stability by extending a small extent in the direction opposite the base 112. It should, however, be appreciated that a 90 degree elbow coupling, as disclosed in conjunction with the first embodiment of the invention, could also serve as the connector as well as other means of effecting the desired angular relationship between framework 111 and base 112.

The base 112 consists of a pair of linear legs 140 and 141. While the legs 140, 141 could take various forms, a tubular leg of polyvinylchloride piping is advantageous. In this instance, and as seen in the broken away portion of leg 141 in FIG. 4, a weighting bar 142 may be provided internally of the legs 140, 141. Depending upon the weight requirements for a particular hurdle configuration to provide the desired overall weight and the desired resistance to pullover forces registered when the hurdle 110 is engaged by a runner, the weighting bar 142 may be of a solid or tubular construction, as appropriate.

It will, thus, be appreciated that the hurdle 110 may be adjusted in height by suitably moving the legs 140, 141 inwardly or outwardly to effect increases or decreases, respectively, in the height of the crossbar 120. In such instances, the position of the moving pivot joining the legs is appropriately adjusted, with the movements of the pivot location taking place by natural movement of the elastomeric band 132 in the case of the floating pivot and by repositioning the fastener 233 in the pivot connection of FIG. 6. As can be seen in chain lines in FIG. 4, an upward positioning of the crossbar 120 from the solid line position to the chain line position 120' results in the legs 140, 141 adjusting to the chain line position 112' and the moving pivot assembly 130 being displaced downwardly from the solid line position to repose at the normal intersection of struts 115' and 116' in the depicted adjusted position. It will also be apparent that the hurdle 110 may be collapsed downwardly such that the struts 115, 116 and the crossbar 120 are all substantially adjacent to each other in a linear configuration. If desired, the legs 140, 141 can be constructed to be removable such that the hurdle 110 can be folded into a compact package for shipping or transporting.

Thus, it should be evident that the adjustable hurdle disclosed herein carries out the various objects of the invention set forth hereinabove and otherwise constitutes an advantageous contribution to the art. As may be apparent to persons skilled in the art, modifications can be made to the preferred embodiments disclosed herein without departing from the spirit of the invention, the scope of the invention being limited solely by the scope of the attached claims.

What is claimed is:

1. Adjustable hurdle apparatus positionable on a running track as a barrier to runners in track events comprising, supporting framework means, horizontal crossbar means to be cleared by runners positioned proximate an extremity of said supporting framework means, and base means attached to said supporting framework means proximate the extremity of said framework means opposite said horizontal crossbar means for normally maintaining said supporting framework means in a substantially vertical orientation relative to the track, said framework means including a pair of cross struts which space and join said horizontal crossbar means and said base means, said cross struts being joined at a moving pivot selectively located for infinitely adjustably vertically positioning said horizontal crossbar means at a desired height from competition heights to heights which are substantially below the lowest competition height.

2. Apparatus according to claim 1, wherein said base means includes weight means for providing a desired resistance to pullover forces.

3. Apparatus according to claim 1, wherein said supporting framework means and said base means are disposed at substantially right angles.

4. Apparatus according to claim 1, wherein said cross struts have a plurality of longitudinally spaced bores and a movable pivot pin positionable in selected bores of said cross struts.

5. Apparatus according to claim 1, wherein said cross struts are joined by clinching means which may be located at selected positions longitudinally of said cross struts.

6. Apparatus according to claim 5, wherein said clinching means includes an elastomeric band having a loop formed therein which interacts with a spaced portion of the elastomeric band and annular grommet means.

7. Apparatus according to claim 1, wherein said base means includes a linear leg joined to each of said cross struts by a coupling and extending substantially perpendicular thereto.

8. Apparatus according to claim 7, wherein each said linear leg is tubular and has internal weight means for increasing the overall weight of the hurdle and providing a desired resistance to pullover forces.

* * * * *